US009362624B2

(12) United States Patent
Stoytchev et al.

(10) Patent No.: US 9,362,624 B2
(45) Date of Patent: Jun. 7, 2016

(54) COMPACT ANTENNA WITH DUAL TUNING MECHANISM

(71) Applicant: GALTRONICS CORPORATION LTD., Tiberias (IL)

(72) Inventors: Marin Stoytchev, Chandler, AZ (US); Randell Cozzolino, Phoenix, AZ (US)

(73) Assignee: GALTRONICS CORPORATION, LTD, Tiberias (IL)

( * ) Notice: Subject to any disclaimer, the term of this patent is extended or adjusted under 35 U.S.C. 154(b) by 59 days.

(21) Appl. No.: 14/514,977

(22) Filed: Oct. 15, 2014

(65) Prior Publication Data

US 2015/0102974 A1 Apr. 16, 2015

Related U.S. Application Data

(60) Provisional application No. 61/891,449, filed on Oct. 16, 2013.

(51) Int. Cl.

| | |
|---|---|
| ***H01Q 11/00*** | (2006.01) |
| ***H01Q 9/04*** | (2006.01) |
| ***H01Q 5/371*** | (2015.01) |
| *H01Q 9/16* | (2006.01) |

(52) U.S. Cl.

CPC ..... *H01Q 9/0421* (2013.01); *H01Q 5/371* (2015.01)

(58) Field of Classification Search

CPC ..... H01Q 5/371; H01Q 9/045; H01Q 9/0421; H01Q 5/0027

See application file for complete search history.

(56) References Cited

U.S. PATENT DOCUMENTS

| | | | | |
|---|---|---|---|---|
| 8,203,499 | B2 * | 6/2012 | Cozzolino | H01Q 1/36 29/601 |
| 8,519,903 | B2 * | 8/2013 | Cozzolino | H01Q 1/36 343/821 |
| 2011/0063172 | A1 * | 3/2011 | Podduturi | H01Q 1/2233 343/700 MS |
| 2013/0342415 | A1 * | 12/2013 | Cozzolino | H01Q 1/36 343/821 |
| 2014/0132469 | A1 * | 5/2014 | Wang | H01Q 1/2266 343/821 |

* cited by examiner

*Primary Examiner* — Trinh Dinh

(74) *Attorney, Agent, or Firm* — Ingrassia Fisher & Lorenz, P.C.

(57) ABSTRACT

An antenna, including at least one set of conductive arms radiative at a resonant frequency, the at least one set of conductive arms including a first conductive arm having a first terminus and a second conductive arm having a second terminus, the first and second termini being closely spaced so as to form a capacitive gap therebetween, the capacitive gap having a width, a feed connection located on the first conductive arm, a first electrical length being defined along the first conductive arm between the feed connection and the first terminus, a ground connection located on the second conductive arm, a second electrical length being defined along the second conductive arm between the ground connection and the second terminus, the resonant frequency depending at least on the width of the capacitive gap and on the first and second electrical lengths, a total electrical length along the set of conductive arms between the first and second termini being less than or equal to half of a wavelength corresponding to the resonant frequency, and a balun coupled to the first and second conductive arms.

20 Claims, 7 Drawing Sheets

COMPACT ANTENNA WITH DUAL TUNING MECHANISM

REFERENCE TO RELATED APPLICATIONS

Reference is hereby made to U.S. Provisional Patent Application 61/891,449, entitled COMPACT BALANCED LINEARLY-POLARIZED SINGLE-BAND ANTENNA WITH DUAL TUNING MECHANISM, filed Oct. 16, 2013, the disclosure of which is hereby incorporated by reference and priority of which is hereby claimed pursuant to 37 CFR 1.78 (a)(4) and (5)(i).

FIELD OF THE INVENTION

The present invention relates generally to antennas and more particularly to compact antennas.

BACKGROUND OF THE INVENTION

Various types of compact antennas are known in the art.

SUMMARY OF THE INVENTION

The present invention seeks to provide an improved extremely compact single- and multi-band antenna having a dual tuning mechanism.

There is thus provided in accordance with a preferred embodiment of the present invention an antenna, including at least one set of conductive arms radiative at a resonant frequency, the at least one set of conductive arms including a first conductive arm having a first terminus and a second conductive arm having a second terminus, the first and second termini being closely spaced so as to form a capacitive gap therebetween, the capacitive gap having a width, a feed connection located on the first conductive arm, a first electrical length being defined along the first conductive arm between the feed connection and the first terminus, a ground connection located on the second conductive arm, a second electrical length being defined along the second conductive arm between the ground connection and the second terminus, the resonant frequency depending at least on the width of the capacitive gap and on the first and second electrical lengths, a total electrical length along the set of conductive arms between the first and second termini being less than or equal to half of a wavelength corresponding to the resonant frequency, and a balun coupled to the first and second conductive arms.

In accordance with a preferred embodiment of the present invention, the at least one set of conductive arms includes a single set of conductive arms.

In accordance with another preferred embodiment of the present invention, the at least one set of conductive arms and the balun include a unitary conductive element.

Preferably, the feed connection includes an inner conductor of a coaxial cable.

Preferably, the ground connection includes an outer conductive shield of the coaxial cable.

Preferably, the width of the capacitive gap is greater than or equal to 1/100 of the wavelength.

Preferably, the width of the capacitive gap is less than or equal to 1/10 of the wavelength.

Preferably, the first electrical length is smaller than the second electrical length.

Preferably, the balun is directly coupled to the feed and ground connections.

Preferably, the balun is integrally formed with the first and second conductive arms.

Preferably, the balun is non-overlapping with the first and second conductive arms.

Alternatively, the balun is partially overlapping with at least one of the first and second conductive arms.

In accordance with a further preferred embodiment of the present invention, the antenna has a two-dimensional configuration.

Alternatively, the antenna has a three-dimensional configuration.

Preferably, each one of the first and second conductive arms includes linear portions having uniform thicknesses.

Additionally or alternatively, at least one of the first and second conductive arms includes at least one non-linear portion.

In accordance with yet a further preferred embodiment of the present invention, the at least one set of conductive arms includes a first set of conductive arms and a second set of conductive arms.

Preferably, the first set of conductive arms is radiative at a low-band resonant frequency and the second set of conductive arms is radiative at a high-band resonant frequency.

Preferably, at least one of the first and second sets of conductive arms is partially overlapping with the balun.

In accordance with a still further preferred embodiment of the present invention, the antenna also includes a third set of conductive arms radiative in an additional frequency band, the additional frequency band being offset from the low-band and high-band resonant frequencies.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
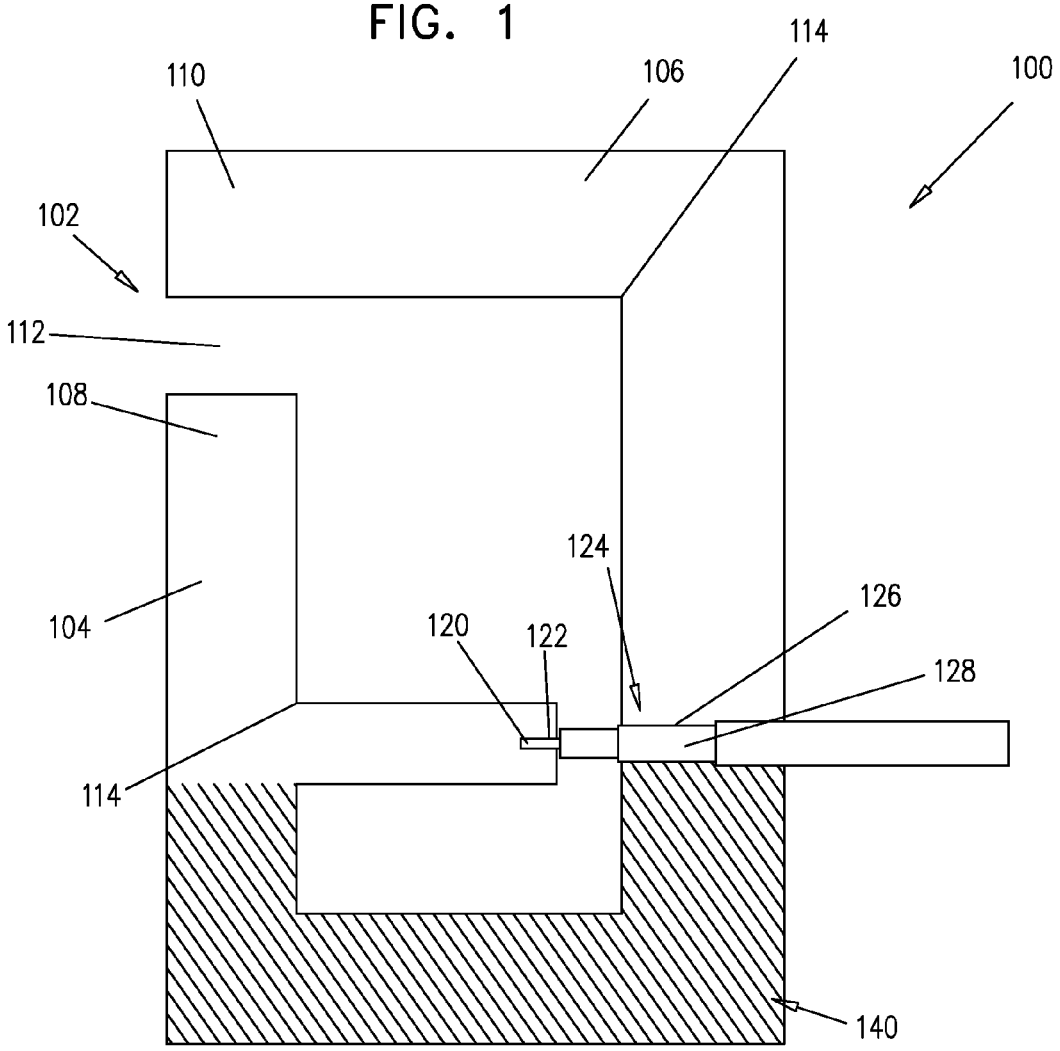
FIG. 1 is a simplified schematic illustration of an antenna constructed and operative in accordance with a preferred embodiment of the present invention.

Reference is now made to FIG. 1, which is a simplified schematic illustration of an antenna constructed and operative in accordance with a preferred embodiment of the present invention.

As seen in FIG. 1, there is provided an antenna 100 comprising at least one set of conductive arms 102, here embodied, by way of example, as a single set of conductive arms 102 including a first conductive arm 104 and a second conductive arm 106. First and second conductive arms 104 and 106 may be formed as a continuous unitary conductive structure having a first extremity located at a first terminus 108 of first conductive arm 104 and a second extremity located at a second terminus 110 of second conductive arm 106. First and second conductive arms 104 and 106 are preferably operative to radiate at a resonant frequency having an associated corresponding wavelength.

First and second termini 108 and 110 of first and second conductive arms 104 and 106 respectively are preferably closely spaced so as to form a capacitive gap 112 therebetween. The close spacing of first and second termini 108 and 110 may be achieved by way of the bending of first and second conductive arms 104 and 106 in a mutually approaching configuration, as illustrated in FIG. 1 wherein each one of first and second conductive arms 104 and 106 includes an orthogonal bend 114. Alternatively, only one of first and second conductive arms 104 and 106 may be bent so as to bring a terminus thereof in close proximity to a terminus of the other conductive arm. It is appreciated that one or both of first and second conductive arms 104 and 106 may include multiple bends and may include sinuous and/or angular bends, according to the design requirements of a host device of antenna 100.

The close spacing of first and second termini 108 and 110 of first and second conductive arms 104 and 106 and consequent formation of capacitive gap 112 therebetween is a particularly advantageous feature of a preferred embodiment of the present invention, rendering antenna 100 extremely compact and providing a tuning mechanism for the resonant frequency at which first and second conductive arms 104 and 106 radiate, as will be detailed henceforth.

A feed connection 120 is preferably located on first conductive arm 104, whereby antenna 100 is fed. A first electrical length may be defined along first conductive arm 104 between feed connection 120 and first terminus 108. In FIG. 1, feed connection 120 is shown to be embodied, by way of example, as a contact point of a central core 122 of a coaxial cable 124 to first conductive arm 104. It is appreciated, however, that feed connection 120 may alternatively be embodied in other forms by way of the employment of alternative feed arrangements, such as a microstrip feed arrangement, as are well known in the art.

A ground connection 126 is preferably located on second conductive arm 106, whereby antenna 100 is grounded. A second electrical length may be defined along second conductive arm 106 between ground connection 126 and second terminus 110. In FIG. 1, ground connection 126 is shown to be embodied, by way of example, as a contact point of a grounded metallic shield 128 of coaxial cable 124 to second conductive arm 106. It is appreciated, however, that ground connection 126 may alternatively be embodied in other forms and is not limited to being formed by a grounded conductor of a coaxial cable.

As will be readily understood from the foregoing description, antenna 100 thus includes at least two radiative arms, here embodied by way of example as a first radiative arm 104 and a second radiative arm 106, one of the arms being fed and the other one of the arms being grounded. In this aspect, antenna 100 somewhat resembles a conventional dipole antenna including two dipole arms. However, in contrast to conventional dipole antennas in which the respective tips of the dipole arms are spaced far apart in order to avoid degradation of the dipole radiating efficiency, in antenna 100 termini 108 and 110 of radiative arms 104 and 106 are closely spaced so as to create capacitive coupling therebetween at capacitive gap 112.

In operation of antenna 100, the inductance arising due to the first and second electrical lengths of first and second conductive arms 104 and 106 is at least partially cancelled by the capacitance arising due to the close proximity of first and second termini 108 and 110. The resonant frequency at which antenna 100 radiates is therefore a function of at least the antenna inductance, due to the arm lengths, and the antenna capacitance, due to the spacing between the tips of the arms 104 and 106. The resonant frequency of antenna 100 thus depends at least on a width of capacitive gap 112 and on the first and second electrical lengths of first and second conductive arms 104 and 106. By way of adjustment of these parameters, the resonant frequency of antenna 100 may be tuned. Antenna 100 hence may be described as having a dual-tuning mechanism, whereby the resonance frequency thereof may be modified by way of modification to the first and second respective electrical lengths of the conductive arms 104 and 106 as well as by modification to the strength of the capacitive coupling between the ends 108, 110 of the conductive arms 104, 106. This creates additional degrees of freedom in tuning antenna 100, in comparison to conventional dipole antennas in which no such dual-tuning mechanism is typically present and antenna resonance depends on dipole arm length alone.

Additionally, the close spacing of termini 108 and 110 of conductive arms 104 and 106 renders antenna 100 particularly compact, in contrast to conventional antennas in which the conductive arms are preferably spaced at a maximal distance from each other in order to maintain radiating efficiency. Furthermore, the close spacing of termini 108 and 110 leads to the creation of highly localized electromagnetic fields in the region of capacitive gap 112, thus concentrating the near-field electromagnetic energy of antenna 100 and thereby reducing the undesirable influence of neighboring conductive structures on the radiation pattern of antenna 100.

It has been found that antenna 100 operates optimally when the width of the capacitive gap 112 lies between approximately $1/100\lambda$ and $1/10\lambda$, wherein $\lambda$ is a wavelength corresponding to the resonant frequency of antenna 100. It is appreciated that even if made extremely small, capacitive gap 112 is preferably not eliminated entirely in antenna 100, such that antenna 100 comprises at least two delineable radiative arms, the termini 108,110 of which do not meet to form a loop antenna structure.

Furthermore, it has been found that antenna 100 operates optimally when the first electrical length of first, fed conductive arm 104 is somewhat shorter than the second electrical length of second, grounded, conductive arm 106. The offset in electrical lengths between the first and second conductive arms 104 and 106 may be very slight, such as approximately $1/10\lambda$, or may be larger, such as approximately $1/3\lambda$ or may take any other value.

Additionally, it has been found that antenna 100 operates optimally when a total electrical length along set of conductive arms 102, between first and second termini 108 and 110, is less than or equal to approximately half of a wavelength corresponding to the resonant frequency of the antenna. Antenna 100 is thus an electrically small antenna and may be readily incorporated into a variety of wireless devices in a compact fashion.

In order to minimize unwanted currents along grounded metallic shield 128 and thus preserve the electrical performance of antenna 100, a balun structure 140 is preferably coupled to and may be integrally formed with first and second conductive arms 104 and 106. An extent of balun structure 140 is indicated in FIG. 1 by a hatched region, although it is appreciated that a portion of antenna 100 electrically operating as balun structure 140 may not exactly correspond to the boundaries of the hatched region and that the extents of the hatched region are generally representative and exemplary only.

Balun structure 140 may be formed interfacing first and second conductive arms 104 and 106 and may be directly coupled to feed connection 120 and ground connection 126 and thus to first and second conductive arms 104 and 106. As appreciated from consideration of the relative location of balun structure 140 and first and second conductive arms 104 and 106 in FIG. 1, balun structure 140 may comprise a separate portion of antenna 100, non-overlapping with first and second conductive arms 104 and 106 and therefore not acting as a radiating element in antenna 100. Alternatively, as will be exemplified henceforth with respect to FIG. 5, balun structure 140, or an equivalent thereof, may partially overlap with at least one of conductive arms 104 and 106 and may therefore have a secondary radiating function in addition to its primary impedance matching function.

In operation of antenna 100, first and second conductive arms 104 and 106 preferably radiate linearly polarized radiation and preferably radiate in the far-field range. Antenna 100 may operate as a single-band antenna over a wide range of radiating frequencies, such as approximately 300 MHz-80 GHz. In the case that the total electrical length along set of conductive arms 102, between first and second termini 108 and 110, is equal to approximately $\lambda/2$, a first electrical length of first conductive arm 104 may lie in the range of $0.1\lambda$ to $0.2\lambda$ and a second electrical length of second conductive arm 106 may lie in the range of $0.3\lambda$ to $0.4\lambda$. It is appreciated, however, that these electrical dimensions are exemplary only and may be readily adjusted in accordance with the size of capacitive gap 112 in order to achieved desired antenna tuning.

Antenna 100 may be formed as a uniform metal element or may be formed as a conductive material printed, plated or otherwise deposited on a dielectric substrate such as a printed circuit board substrate. Antennas constructed and operative in accordance with preferred embodiments of the present invention may additionally or alternatively include mounting features in order to facilitate integration within a wireless device, as will be described in more detail with reference to FIG. 3 henceforth. Antennas constructed and operative in accordance with preferred embodiments of the present invention may be mounted on a dedicated dielectric carrier for integration within a wireless device or may be adapted for mounting on a metal chassis or other pre-existing conductive surface of a wireless device.

Figure 2A:
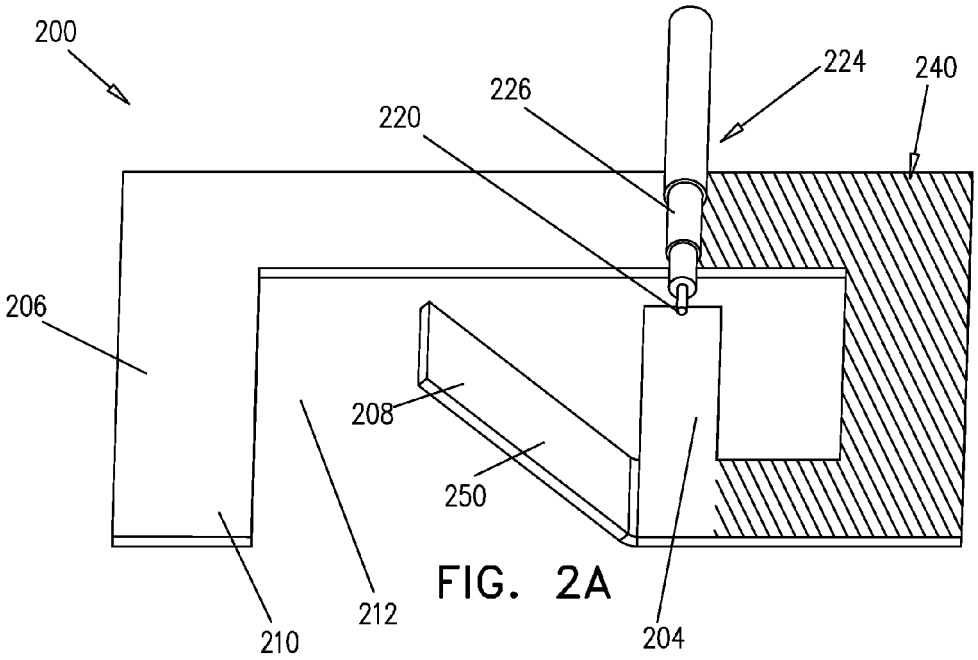
FIGS. 2A, 2B and 2C are simplified respective schematic illustrations of alternative configurations of an antenna of the type illustrated in FIG. 1, constructed and operative in accordance with other preferred embodiments of the present invention.
Figure 2B:
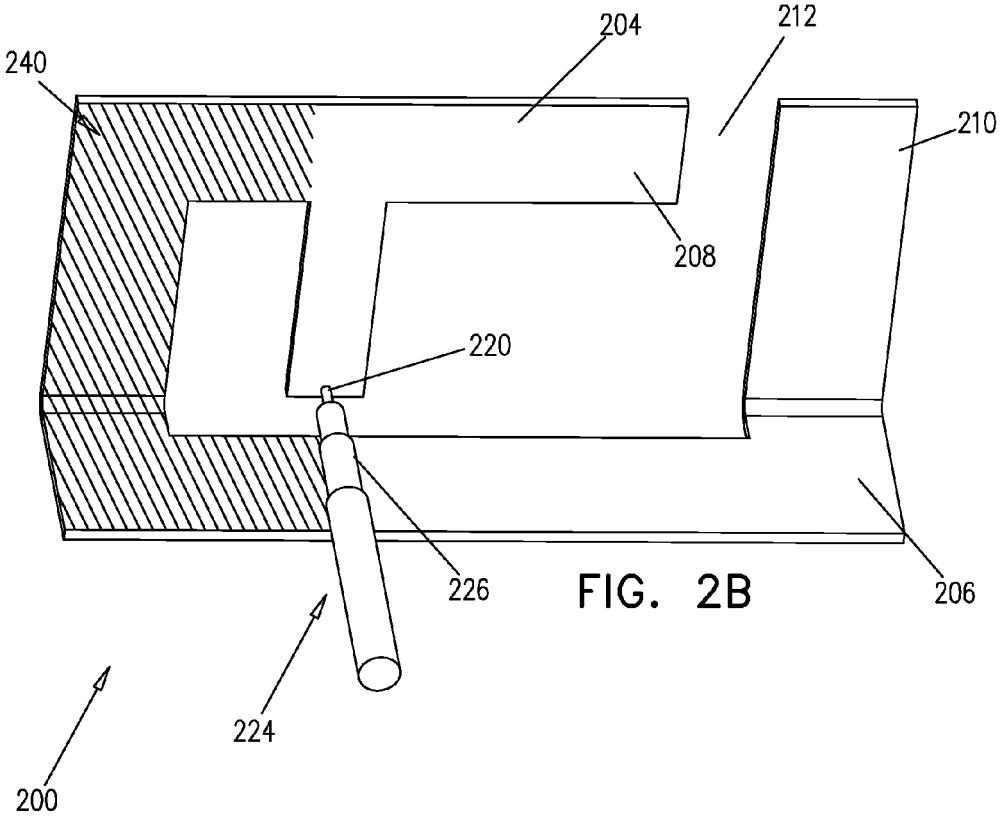
Figure 2C:
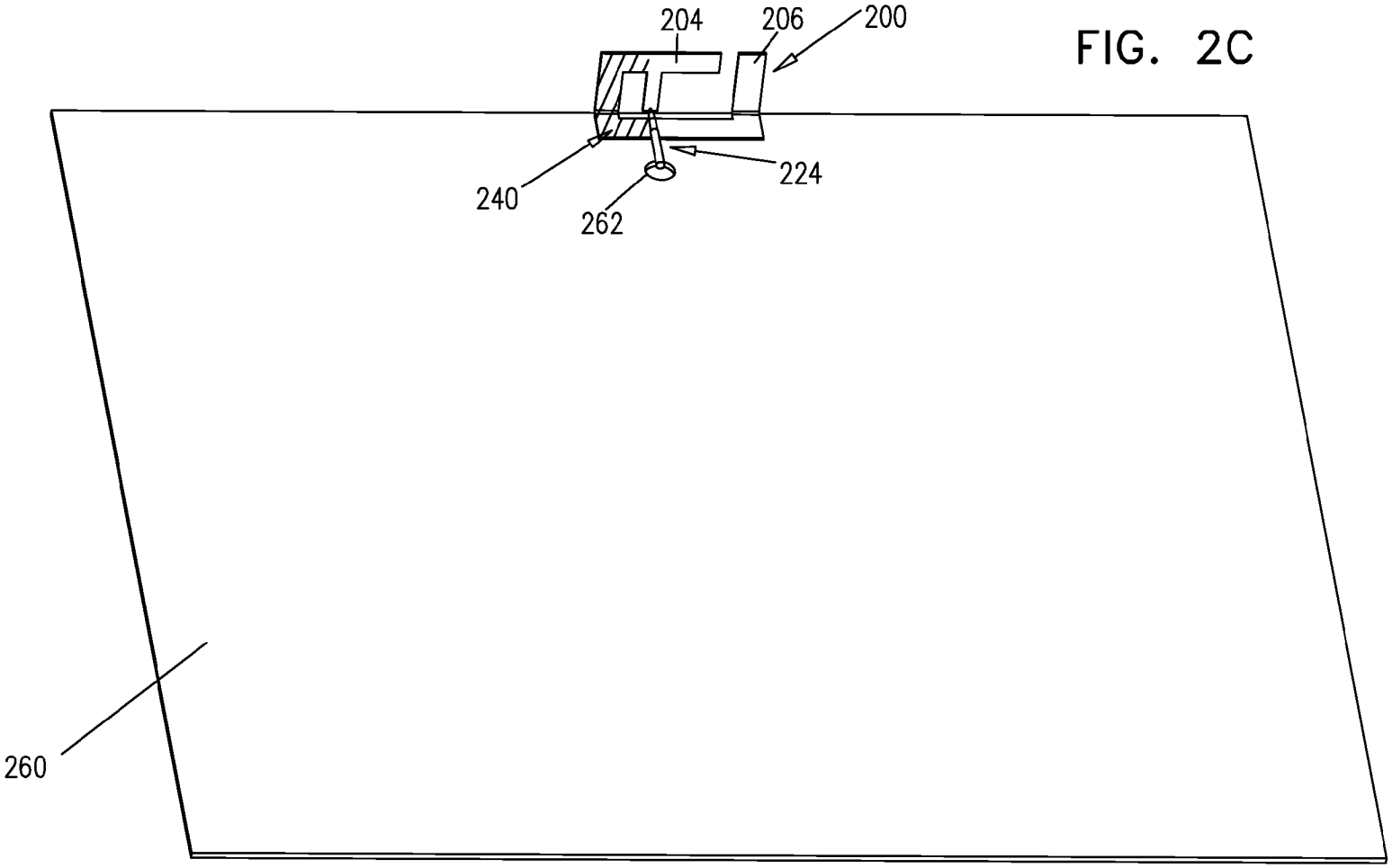

Antenna 100 may have a two-dimensional (2D) structure and may be configured as a planar, sheet-like element. Alternatively, antenna 100 may be configured as a three-dimensional (3D) structure, as in the case of alternative preferred embodiments of the antenna of the present invention respectively illustrated in FIGS. 2A-2C. As seen in FIGS. 2A-2C, antenna 100 may be folded so as to form an antenna 200, generally resembling antenna 100 in all relevant aspects thereof with the exception of antenna 200 being folded so as to form a 3D antenna element. Antenna 200 may include a first conductive arm 204 and a second conductive arm 206, respectively having a first terminus 208 and a second terminus 210 closely spaced with respect to first terminus 208 and separated therefrom by a small capacitive gap 212. Antenna 200 may further include a feed connection 220 formed by a coaxial cable 224, a ground connection 226 and a balun region 240 bridging therebetween. As seen in FIG. 2A, a tip 250 in the region of first terminus 208 of first conductive arm 204 may be folded, so as to increase a width of capacitive gap 212 in comparison to a width of capacitive gap 112 and thus modify a resonant frequency of antenna 200 in comparison to that of antenna 100. In the case that the capacitive gap is formed between termini that are not co-planar, as by way of example in the case of capacitive gap 212, the width of the capacitive gap may be defined as the shortest straight line displacement between the termini extremities.

Additionally or alternatively, as seen in FIGS. 2B and 2C, a portion of second conductive arm 206 and of balun region 240 may be folded so as to form a 3D antenna element, which 3D element may be mounted on a conductive structure, such as a conductive sheet 260 illustrated in FIG. 2C. Conductive sheet 260 may include a hole 262, through which hole 262 coaxial cable 224 may be threaded. It is appreciated that the various configurations of antennas 100 and 200 illustrated in FIGS. 1-2C are exemplary only and that various other 2D and 3D configurations are possible and will be obvious to one skilled in the art, including configurations having single or multiple acute and/or obtuse folds in a single or in multiple planes.

Figure 3:
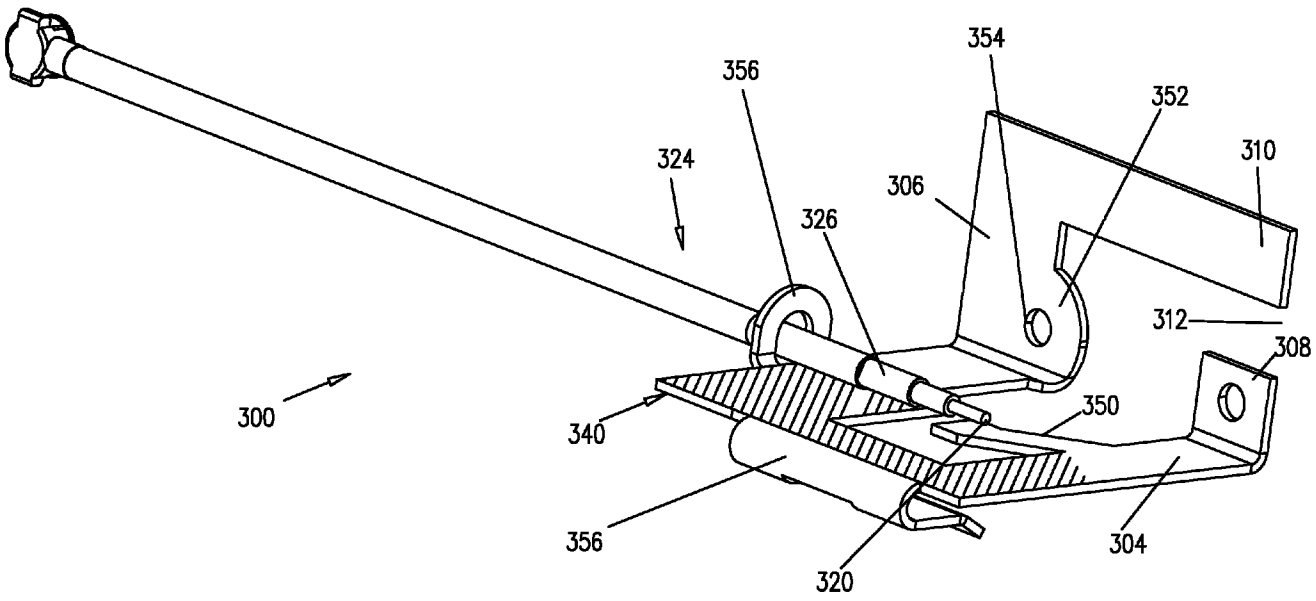
FIG. 3 is a simplified schematic illustration of an antenna constructed and operative in accordance with a further preferred embodiment of the present invention.

It is further appreciated that although the embodiments of antennas 100 and 200 illustrated in FIGS. 1-2C are shown to comprise linear portions having generally uniform thicknesses and compositions, preferred embodiments of the antenna of the present invention may include antenna embodiments having non-linear portions of varying thicknesses, as seen, by way of example, in the case of a 3D antenna 300 illustrated in FIG. 3.

As seen in FIG. 3, antenna 300 may include a first conductive arm 304 and a second conductive arm 306, respectively having a first terminus 308 and a second terminus 310 closely spaced with respect to first terminus 308 and separated therefrom by a small capacitive gap 312. Antenna 300 may further include a feed connection 320 formed by an inner conductor of a coaxial cable 324, a ground connection 326 formed by an outer conductive shield of coaxial cable 324, and a balun region 340 bridging therebetween.

Antenna 300 may be configured as a 3D element by way of the bending of first terminus 308 and of a portion of second conductive arm 306 so as to lie in a common plane, generally perpendicular to the plane defined by balun 340. First conductive arm 304 may include a non-linear neck portion 350, upon which non-linear neck portion 350 feed connection 320 may rest. Similarly, second conductive arm 306 may include a widened scalloped corner portion 352 adapted for the formation therein of a mounting hole 354. Antenna 300 may further include additional protruding features 356 adapted for the mounting of antenna 300 within a host device.

It is appreciated that antenna 300, but for the inclusion therein of various non-linear, non-uniform portions, may generally resemble antennas 100 and 200 in relevant aspects thereof and may operate in accordance with the above-described operation of antennas 100-200. It is further appreciated that although the inclusion of non-linear, non-uniform portions is illustrated with respect to 3D antenna 300, one skilled in the art may readily modify 2D antenna 100 and/or 3D antenna 200 so as to include similar non-linear, non-uniform portions according to the design requirements of the antenna.

Figure 4:
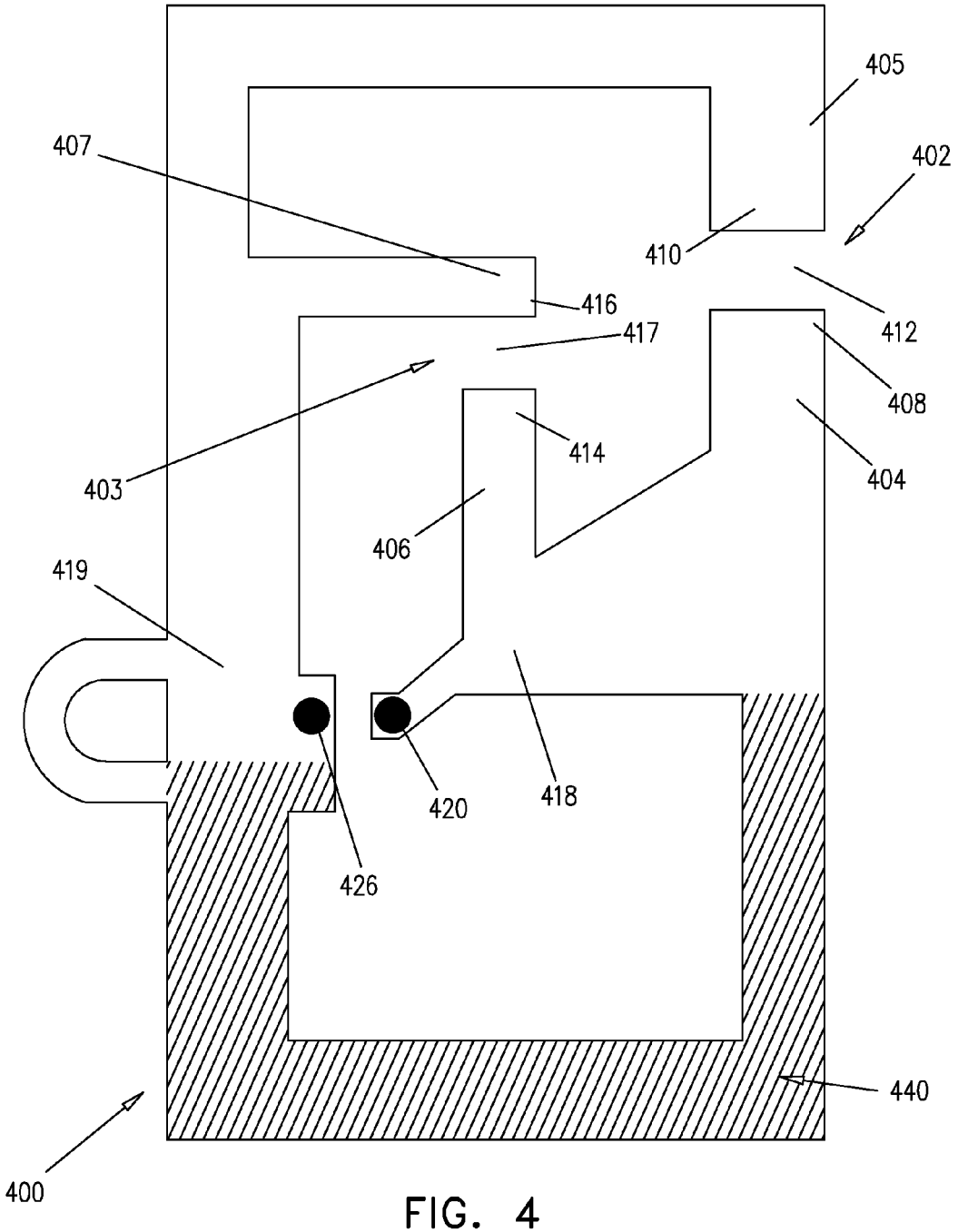
FIG. 4 is a simplified schematic illustration of an antenna constructed and operative in accordance with yet another preferred embodiment of the present invention.

Reference is now made to FIG. 4, which is a simplified schematic illustration of an antenna constructed and operative in accordance with yet another preferred embodiment of the present invention.

As seen in FIG. 4, there is provided an antenna 400 comprising at least one set of conductive arms, here embodied, by way of example, as a first set of low-band conductive arms 402 and a second set of high-band conductive arms 403. The first low-band set of conductive arms 402 may include a first low-band conductive arm 404 and a second low-band conductive arm 405. The second high-band set of conductive arms 403 may include a third high-band conductive arm 406 and a fourth high-band conductive arm 407.

First and second sets of low- and high-band conductive arms 402 and 403 may be formed as a continuous unitary conductive structure. First set of low-band conductive arms 402 may have a first extremity located at a first terminus 408 of first low-band conductive arm 404 and a second extremity located at a second terminus 410 of second low-band conductive arm 405. First and second low-band conductive arms 404 and 405 are preferably operative to radiate at a low-band resonant frequency having an associated corresponding wavelength. First and second termini 408 and 410 of first and second low-band conductive arms 404 and 405 respectively are preferably closely spaced so as to form a low-band capacitive gap 412 therebetween.

Second set of high-band conductive arms 403 may have a third extremity located at a third terminus 414 of third low-band conductive arm 406 and a fourth extremity located at a fourth terminus 416 of fourth low-band conductive arm 407. Third and fourth high-band conductive arms 406 and 407 are preferably physically and electrically shorter than first and second low-band conductive arms 404 and 405 and are therefore preferably operative to radiate at a high-band resonant frequency having an associated corresponding wavelength. Third and fourth termini 414 and 416 of third and fourth high-band conductive arms 406 and 407 respectively are preferably closely spaced so as to form a high-band capacitive gap 417 therebetween.

The close spacing of first and second termini 408 and 410 of first set of low-band conductive arms 402 and of third and fourth termini 414 and 416 of second set of high-band conductive arms 403 and the consequent formation of respective low- and high-band capacitive gaps 412 and 417, is a particularly advantageous feature of a preferred embodiment of the present invention, rendering antenna 400 extremely compact and providing a tuning mechanism for the resonant frequencies at which first and second sets of low- and high-band conductive arms 402, 403 radiate, as will be detailed henceforth.

The formation of low-band capacitive gap 412 may be achieved by way of the bending of first and second low-band conductive arms 404 and 405 in a mutually approaching configuration. Similarly, the formation of high-band capacitive gap 417 may be achieved by way of the bending of third and fourth conductive arms 406 and 407 in a mutually approaching configuration. Alternatively, only one of first and second low-band conductive arms 404 and 405 and only one of second and third high-band conductive arms 406 and 407 may be bent so as to bring a terminus thereof in close proximity to a terminus of the corresponding conductive arm. It is appreciated that at least one of first-fourth conductive arms 404, 405, 406, 407 may include multiple bends and may include sinuous and/or angular bends, according to the design requirements of a host device of antenna 400.

It is appreciated that although for the purposes of clarity of description, first and second sets of low- and high-band conductive arms 402 and 403 have been distinguished between herein, first and second sets of low- and high-band conductive arms 402 and 403 may be partially overlapping. Thus, first low-band conductive arm 404 and third high-band conductive arm 406 may share a common portion in a region 418 and second low-band conductive arm 405 and fourth high-band conductive arm 407 may share a common portion in a region 419.

A feed connection 420 is preferably located in region 418 on first and third conductive arms 404, 406, whereby antenna 400 is fed. A first electrical length may be defined along first conductive arm 404 between feed connection 420 and first terminus 408. A ground connection 426 is preferably located in region 419 on second and fourth conductive arms 405, 407, whereby antenna 400 is grounded. A second electrical length may be defined along second conductive arm 405 between ground connection 426 and second terminus 410. Correspondingly, a third electrical length may be defined along third conductive arm 406 between feed connection 420 and third terminus 414 and a fourth electrical length may be defined along fourth conductive arm 407 between ground connection 426 and fourth terminus 416.

It is appreciated from the foregoing description that antenna 400 thus generally resembles antenna 100 in relevant aspects thereof, with the exception of the inclusion in antenna 400 of two sets of radiating arms 402, 403, in contrast to the single set of radiating arms 102 included in antenna 100. As a result, antenna 400 may operate as a dual-band antenna, radiating in both low- and high-frequency bands, whereas antenna 100 preferably operates as a single band antenna. Feed and ground connections 420 and 426 may be embodied as inner and outer conductors of a coaxial cable or as other feed and ground connections, such as microstrip connections, as are well known in the art.

As will be readily understood from the foregoing description, antenna 400 thus includes two sets of radiative arms, here embodied by way of example as a first set of low-band radiative arms 402 and a second set of high-band radiative arms 403. Each one of the sets of arms 402, 403 includes one fed arm 404, 406 and another corresponding grounded arm 405, 407. In this respect, each one of the sets of radiating arms 402, 403 in antenna 400 somewhat resembles a conventional dipole antenna including two dipole arms. However, in contrast to conventional dipole antennas in which the respective tips of the dipole arms are spaced far apart in order to avoid degradation of the dipole radiating efficiency, in antenna 400 termini 408 and 410 of first set of low-band radiative arms 402 and termini 414 and 416 of second set of high-band radiative arms 403 are closely spaced so as to create capacitive coupling therebetween at capacitive gaps 412 and 417.

In operation of antenna 400, the inductance arising due to the first and second electrical lengths of first and second low-band conductive arms 404 and 405 is at least partially cancelled by the capacitance arising due to the close proximity of first and second termini 408 and 410. The low-band resonant frequency at which antenna 400 radiates is therefore a function of at least the antenna inductance, due to the low-frequency arm lengths, and the antenna capacitance, due to the spacing between the tips of the arms 404 and 405.

The low-band resonant frequency of antenna 400 thus depends at least on a width of capacitive gap 412 and on the first and second electrical lengths of first and second conductive arms 404 and 405. By way of adjustment of these parameters, the low-band resonant frequency of antenna 400 may be tuned. Antenna 400 hence may be described as having a low-band dual-tuning mechanism, whereby the resonance frequency thereof may be modified by way of modification to the electrical lengths of the conductive arms 404 and 405 as well as by modification to the strength of the capacitive coupling between the ends 408, 410 of the conductive arms 404, 405. This creates additional degrees of freedom in tuning the low-band frequency of operation of antenna 400, in comparison to conventional dipole antennas in which no such dual-tuning mechanism is typically present and antenna resonance depends on dipole arm length alone.

Similarly, the inductance arising due to the third and fourth electrical lengths of third and fourth high-band conductive arms 406 and 407 is at least partially cancelled by the capacitance arising due to the close proximity of third and fourth termini 414 and 416. The high-band resonant frequency at which antenna 400 radiates is therefore a function of at least the antenna inductance, due to the high-frequency arm lengths, and the antenna capacitance, due to the spacing between the tips of the arms 406 and 407.

The high-band resonant frequency of antenna 400 thus depends at least on a width of capacitive gap 417 and on the third and fourth electrical lengths of third and fourth conductive arms 406 and 407. By way of adjustment of these parameters, the high-band resonant frequency of antenna 400 may be tuned. Antenna 400 hence may be described as having a high-band dual-tuning mechanism, whereby the resonance frequency thereof may be modified by way of modification to the electrical lengths of the conductive arms 406 and 407 as well as by modification to the strength of the capacitive coupling between the ends 414, 416 of the conductive arms 406, 407. This creates additional degrees of freedom in tuning the high-band frequency of operation of antenna 400, in comparison to conventional dipole antennas in which no such dual-tuning mechanism is typically present and antenna resonance depends on dipole arm length alone.

Additionally, the close spacing of the respective termini 408, 410 and 414,416 of first and second sets of conductive arms 402, 403, renders antenna 400 particularly compact, in contrast to conventional antennas in which the conductive arms are preferably spaced at a maximal distance from each other in order to maintain radiating efficiency. Furthermore, the close spacing of the termini leads to the creation of highly localized electromagnetic fields in the region of capacitive gaps 412 and 417, thus concentrating the near-field low- and high-band electromagnetic energy of antenna 400 and thereby reducing the undesirable influence of neighboring conductive structures on the radiation pattern of antenna 400.

It has been found that antenna 400 operates optimally when the width of each one of the capacitive gaps 412 and 417 lies between approximately $1/100\lambda$ and $1/10\lambda$, wherein $\lambda$ is a wavelength corresponding to the low-band resonant frequency of antenna 400 in the case of capacitive gap 412 and the high-band resonant frequency of antenna 400 in the case of capacitive gap 417. It is appreciated that even if made extremely small, capacitive gaps 412 and 417 are preferably not eliminated entirely in antenna 400, such that the arms of antenna 400 do not meet to form a loop antenna structure.

Furthermore, it has been found that antenna 400 operates optimally when the first electrical length of first, fed low-band conductive arm 404 is somewhat shorter than the second electrical length of second, grounded, low-band conductive arm 405 and when the third electrical length of third, fed high-band conductive arm 406 is somewhat shorter than the fourth electrical length of fourth, grounded, high-band conductive arm 407. The offset in electrical lengths between the first and second conductive arms 404 and 405 and between the third and fourth conductive arms 406 and 407 may be very slight, such as approximately $1/10\lambda$, or may be larger, such as approximately $1/3\lambda$ or may take any other value.

Additionally, it has been found that antenna 400 operates optimally when a total electrical length along first set of conductive arms 402, between first and second termini 408 and 410 is less than or equal to approximately half of a wavelength corresponding to the low-band resonant frequency of the antenna and when a total electrical length along second set of conductive arms 403, between third and fourth termini 414 and 416 is less than or equal to approximately half of a wavelength corresponding to the high-band resonant frequency. Antenna 400 is thus an electrically small antenna and may be readily incorporated into a variety of wireless devices in a compact fashion.

In order to optimize the electrical performance of antenna 400, a balun structure 440 is preferably coupled to and integrally formed with first and second sets of conductive arms 402 and 403. An extent of balun structure 440 is indicated in FIG. 4 by a hatched region, although it is appreciated that a portion of antenna 400 electrically operating as balun structure 440 may not exactly correspond to the boundaries of the hatched region and that the extents of the hatched region are generally representative and exemplary only.

Balun structure 440 may be formed interfacing feed connection 420 and ground connection 426 and may be directly connected thereto. As appreciated from consideration of the relative location of balun structure 440 and first and second sets of conductive arms 402 and 403 in FIG. 4, balun structure 440 may comprise a separate portion of antenna 400, generally non-overlapping with first and second sets of conductive arms 402 and 403 and therefore not acting as a radiating element in antenna 400.

Figure 5:
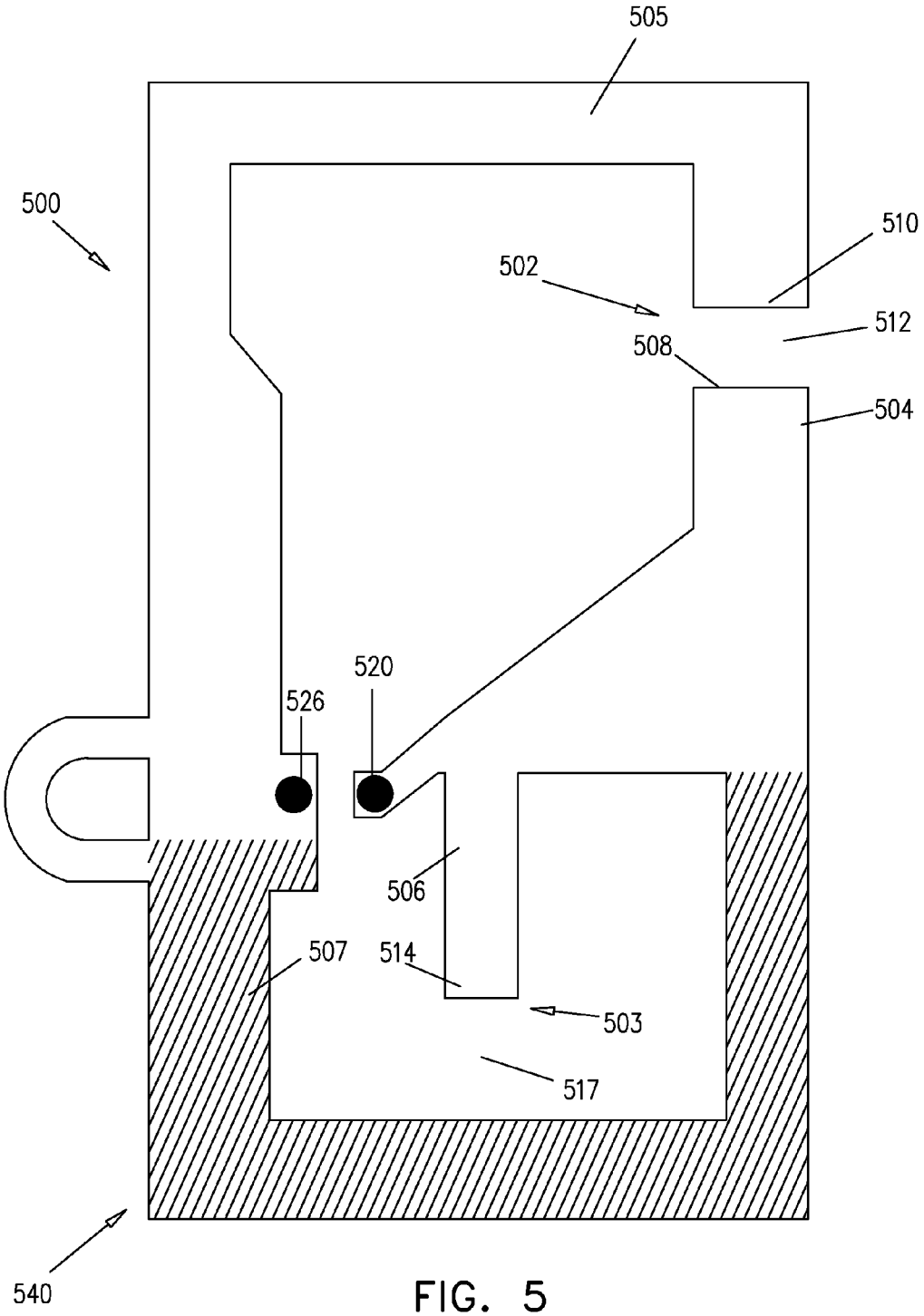
FIG. 5 is a simplified schematic illustration of an antenna constructed and operative in accordance a yet a further preferred embodiment of the present invention.

Alternatively, balun structure 440 may partially overlap with one of conductive arms 404, 405, 406, 407 and may therefore have a secondary radiating function in addition to its primary impedance matching function, as seen in the case of an alternative preferred embodiment of an antenna illustrated in FIG. 5.

Reference is now made to FIG. 5, which is a simplified schematic illustration of an antenna constructed and operative in accordance a yet a further preferred embodiment of the present invention.

As seen in FIG. 5, there is provided an antenna 500 generally resembling antenna 400 in relevant aspects thereof and including a first low-band set of conductive arms 502 and a second high-band set of conductive arms 503, first low-band set of conductive arms 502 comprising a first low-band conductive arm 504 and a second low-band conductive arm 505 and second high-band set of conductive arms 503 comprising a third high-band conductive arm 506 and fourth high-band conductive arm 507. It is a particular feature of a preferred embodiment of antenna 500 that a portion of fourth high-band conductive arm 507 is integrated into the balun structure of the antenna, as will be detailed henceforth, in contrast to antenna 400 in which the balun structure 440 of the antenna is generally non-overlapping with the antenna arms and formed as a separate section with respect thereto.

A first terminus 508 of first low-band conductive arm 504 may be located in close proximity to a second terminus 510 of second low-band conductive arm 505 so as to form a low-band capacitive gap 512 therebetween. A third terminus 514 of third high-band conductive arm 506 may be located in close proximity to fourth high-band conductive arm 507 so as to form a high-band capacitive gap 517 therebetween.

Antenna 500 is preferably fed by a feed connection 520 and grounded by a ground connection 526. An impedance of antenna 500 is improved by way of the inclusion in antenna 500 of a balun 540, which balun 540 is preferably integrally formed with a portion of high-band conductive arm 507. Thus, in contrast to antenna 400 wherein high-band capacitive gap 417 is defined between open-ended termini of high-band conductive arms 406 and 407, in antenna 500 high-band capacitive gap 517 is defined between one open-ended terminus 514 of high-band conductive arm 506 and that portion of conductive arm 507 integrated into balun 540. Other features and advantages of antenna 500 are generally as described with reference to antenna 400.

In operation of antennas 400 and 500, first and second sets of respective low- and high-band conductive arms 402, 403 and 502,503 preferably radiate linearly polarized radiation and preferably transmit in the far-field range. Antennas 400 and 500 may operate as dual-band antennas over a wide range of radiating frequencies, such as frequencies ranging from approximately 300 MHz to 80 GHz. It is understood that although antennas 400 and 500 are shown to be configured as 2D elements, these antennas may readily be folded so as to be configured as 3D elements, according to the design requirements of the antenna host device.

Figure 6:
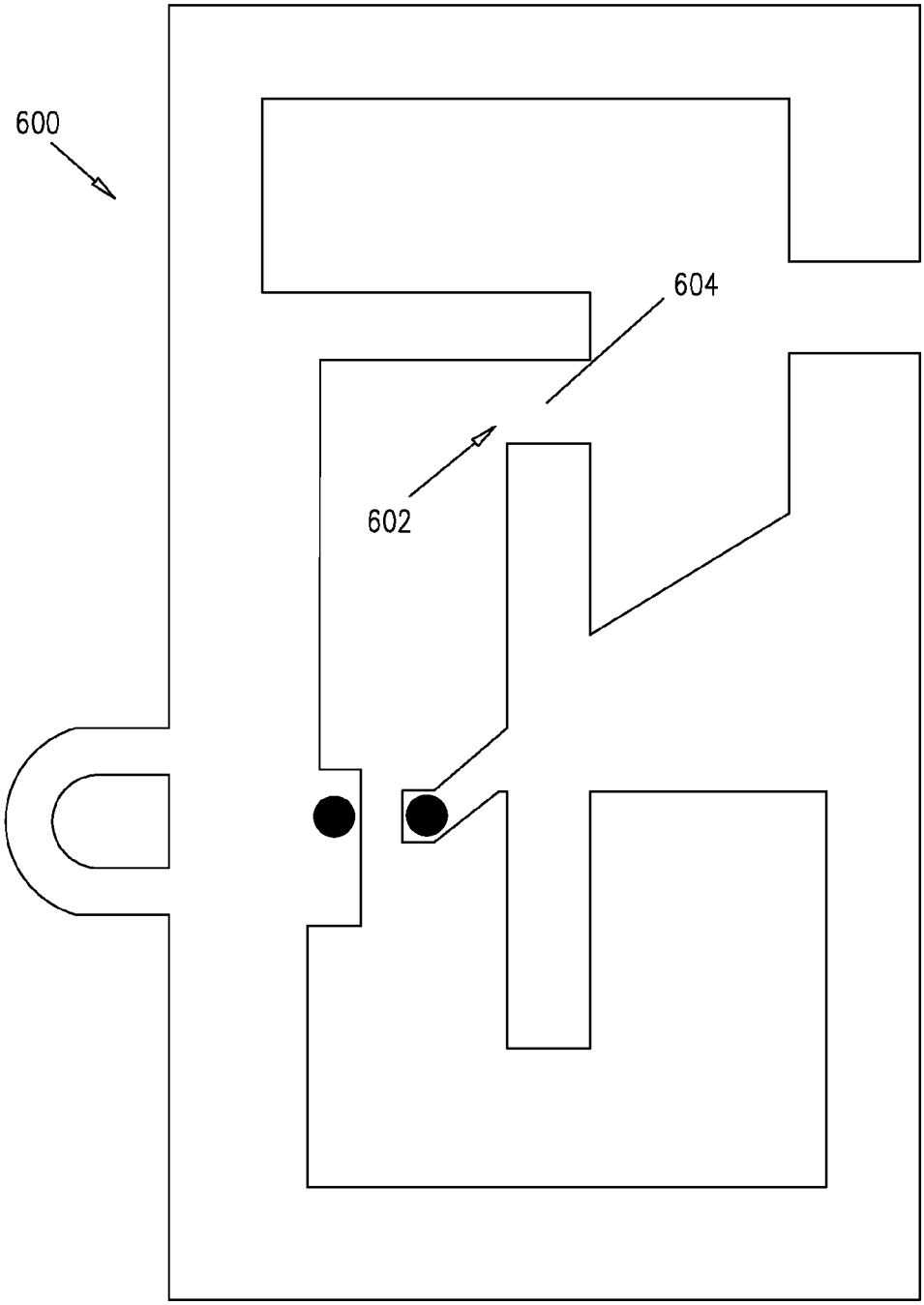
FIG. 6 is a simplified schematic illustration of an antenna constructed and operative in accordance with still another preferred embodiment of the present invention.

In order to increase the number of frequency bands covered by antennas 400 and 500, these antennas may be modified so as to include additional sets of radiating arms, having various electrical and physical lengths and therefore operative over a variety of frequency bands. As seen, by way of example, in the case of an antenna 600 illustrated in FIG. 6, antenna 500 may be modified so as to include an additional set of high-band radiating arms 602, comprising an additional pair of radiating arms having closely spaced termini so as to form an additional capacitive gap 604 therebetween and thus provide an additional high-band resonance in comparison to antenna 500, which additional high-band resonance is preferably offset from the low- and high-band resonances of antenna 500.

It will be appreciated by persons skilled in the art that the present invention is not limited by what has been particularly claimed hereinbelow. Rather, the scope of the invention includes various combinations and subcombinations of the features described hereinabove as well as modifications and variations thereof as would occur to persons skilled in the art upon reading the forgoing description with reference to the drawings and which are not in the prior art.

The invention claimed is:

1. An antenna comprising:

at least one set of conductive arms radiative at a resonant frequency, said at least one set of conductive arms comprising a first conductive arm having a first terminus and a second conductive arm having a second terminus, said first and second termini being closely spaced so as to form a capacitive gap therebetween, said capacitive gap having a width;

a feed connection located on said first conductive arm, a first electrical length being defined along said first conductive arm between said feed connection and said first terminus;

a ground connection located on said second conductive arm, a second electrical length being defined along said second conductive arm between said ground connection and said second terminus, said resonant frequency depending at least on said width of said capacitive gap and on said first and second electrical lengths, a total electrical length along said set of conductive arms between said first and second termini being less than or equal to half of a wavelength corresponding to said resonant frequency; and a balun coupled to said first and second conductive arms.

2. An antenna according to claim 1, wherein said at least one set of conductive arms comprises a single set of conductive arms.

3. An antenna according to claim 1, wherein said at least one set of conductive arms and said balun comprise a unitary conductive element.

4. An antenna according to claim 1, wherein said feed connection comprises an inner conductor of a coaxial cable.

5. An antenna according to claim 4, wherein said ground connection comprises an outer conductive shield of said coaxial cable.

6. An antenna according to claim 1, wherein said width of said capacitive gap is greater than or equal to 1/100 of said wavelength.

7. An antenna according to claim 6, wherein said width of said capacitive gap is less than or equal to 1/10 of said wavelength.

8. An antenna according to claim 1, wherein said first electrical length is smaller than said second electrical length.

9. An antenna according to claim 1, wherein said balun is directly coupled to said feed and ground connections.

10. An antenna according to claim 9, wherein said balun is integrally formed with said first and second conductive arms.

11. An antenna according to claim 9, wherein said balun is non-overlapping with said first and second conductive arms.

12. An antenna according to claim 9, wherein said balun is partially overlapping with at least one of said first and second conductive arms.

13. An antenna according to claim 1, wherein said antenna has a two-dimensional configuration.

14. An antenna according to claim 1, wherein said antenna has a three-dimensional configuration.

15. An antenna according to claim 1, wherein each one of said first and second conductive arms comprises linear portions having uniform thicknesses.

16. An antenna according to claim 1, wherein at least one of said first and second conductive arms comprises at least one non-linear portion.

17. An antenna according to claim 1, wherein said at least one set of conductive arms comprises a first set of conductive arms and a second set of conductive arms.

18. An antenna according to claim 17, wherein said first set of conductive arms is radiative at a low-band resonant frequency and said second set of conductive arms is radiative at a high-band resonant frequency.

19. An antenna according to claim 17, wherein at least one of said first and second sets of conductive arms is partially overlapping with said balun.

20. An antenna according to claim 18, and also comprising a third set of conductive arms radiative in an additional frequency band, said additional frequency band being offset from said low-band and high-band resonant frequencies.

* * * * *